US009770148B2

(12) United States Patent
Bosses

(10) Patent No.: US 9,770,148 B2
(45) Date of Patent: Sep. 26, 2017

(54) VACUUM CLEANER WITH ADJUSTABLE VENT

(71) Applicant: Zenith Technologies, LLC, Fort Lauderdale, FL (US)

(72) Inventor: Mark D. Bosses, Boca Raton, FL (US)

(73) Assignee: ZENITH TECHNOLOGIES, LLC, Fort Lauderdale, FL (US)

( * ) Notice: Subject to any disclaimer, the term of this patent is extended or adjusted under 35 U.S.C. 154(b) by 439 days.

(21) Appl. No.: 14/511,376

(22) Filed: Oct. 10, 2014

(65) Prior Publication Data

US 2015/0101144 A1 Apr. 16, 2015

Related U.S. Application Data

(60) Provisional application No. 61/889,748, filed on Oct. 11, 2013.

(51) Int. Cl.

| | |
|---|---|
| ***A47L 9/04*** | (2006.01) |
| ***A47L 5/30*** | (2006.01) |
| ***A47L 9/00*** | (2006.01) |
| *A47L 5/28* | (2006.01) |

(52) U.S. Cl.

CPC ..... *A47L 9/0072* (2013.01); *A47L 5/30* (2013.01); *A47L 9/0477* (2013.01); *A47L 5/28* (2013.01)

(58) Field of Classification Search

CPC ..... A47L 9/04; A47L 9/0072; A47L 9/0477; A47L 5/30; A47L 5/28

USPC ..... 15/375

See application file for complete search history.

(56) References Cited

U.S. PATENT DOCUMENTS

| | | | | |
|---|---|---|---|---|
| 2,561,964 | A * | 7/1951 | Anderson | A47L 5/30 15/324 |
| 3,277,512 | A * | 10/1966 | Waters | A47L 5/32 15/337 |
| 5,265,305 | A | 11/1993 | Kraft | |
| 7,278,181 | B2 | 10/2007 | Harris | |
| 7,409,742 | B2 | 8/2008 | Song | |
| 8,424,156 | B2 * | 4/2013 | Hsu | A47L 5/24 15/339 |
| 2011/0131757 | A1 | 6/2011 | Heed | |
| 2012/0233806 | A1 * | 9/2012 | Streciwilk | A47L 5/28 15/347 |
| 2012/0285394 | A1 | 11/2012 | Freidell | |

* cited by examiner

*Primary Examiner* — Laura C Guidotti

(74) *Attorney, Agent, or Firm* — Global IP Counselors, LLP

(57) ABSTRACT

A vacuum cleaner includes a housing, suction path, a motor, and a base. The suction path is in fluid communication with the housing. The motor creates flow through the suction path. The base includes a first inlet and a second inlet. The first inlet is in fluid communication with the suction path. The second inlet is adjustable between a first position allowing fluid to flow through the second inlet and a second position preventing at least a portion of fluid from flowing through the second inlet. The second inlet may include a door moveable between the first position and the second position to adjust the amount of airflow.

20 Claims, 5 Drawing Sheets

VACUUM CLEANER WITH ADJUSTABLE VENT

CLAIM TO PRIORITY

This application is based on provisional application Ser. No. 61/889,748, filed Oct. 11, 2013, the disclosure of which is incorporated herein by reference and to which priority is claimed.

FIELD

Various exemplary embodiments relate to a vacuum cleaner having adjustable suction.

BACKGROUND

Vacuum cleaners typically use a suction nozzle that is movable across a surface to be cleaned. The suction created at an inlet in the nozzle results in the removal of free dirt particles accumulated on the surface. However, ground in dirt is frequently encountered when cleaning carpets or other textured surfaces, and reliance on suction for removal of such ground-in dirt has proven to be unsatisfactory.

Vacuum cleaners are provided with devices that agitate the carpet surface to dislodge ingrained dirt particles. For example mechanical beaters, which physically strike the carpet surface to loosen dirt particles. Such agitators are often located on the vacuum cleaner nozzle head, so that dirt can be dislodged and instantly removed by moving the nozzle head across a soiled carpet surface. An example of a mechanical beater is a cylindrical rotatable beater brush having a plurality of extending resilient bristles and prongs that physically beat the carpet as the nozzle head is moved.

A recent trend in carpet manufacturing is soft carpets, which are made of softer yarns. Denier quantifies the softness of the yarn, and is the weight in grams of 9,000 meters of the yarn. The larger the denier, the thicker the yarn. Denier per filament (DPF) represents the size of an individual filament of the yarn. The lower the DPF, the softer the fiber. Traditional home carpets have a DPF of between approximately 12-18. The new soft carpet trend has resulted in carpets having a DPF between approximately 3.5 to 4.5. These soft yarns can have three to four times as many filaments as in the traditional home carpets. Traditional strands of yarn have approximately 120 filaments. The soft strands of yarn can have approximately 700 or more filaments.

SUMMARY OF THE INVENTION

In an exemplary embodiment, a surface cleaner includes a housing, suction path, a motor, and a base. The suction path is in fluid communication with the housing. The motor creates flow through the suction path. The base includes a first inlet and a second inlet. The first inlet is in fluid communication with the suction path. The second inlet is adjustable between a first position allowing fluid to flow through the second inlet and a second position preventing at least a portion of fluid from flowing through the second inlet.

Another exemplary embodiment includes a surface cleaner having a housing, a suction path, a motor, a base, and a cover plate. The suction path is in fluid communication with the housing. The motor creates flow through the suction path. The base includes a top surface, a lower surface, and a suction inlet in fluid communication with the suction path. The cover plate is connected to the lower surface and has a vent opening.

Another exemplary embodiment is directed to a method of adjusting the airflow in a surface cleaner. A surface cleaner is positioned adjacent to a surface. The surface cleaner includes a base having a top surface, a lower surface, and a suction path, a motor for creating flow through the suction path, a suction inlet positioned in the base, and an adjustable vent positioned in the base and in fluid communication with the suction path. The vent is selectively adjusted between a closed position and an open position to vary the amount of airflow through the suction path.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF AN EXEMPLARY EMBODIMENT

Figure 1:
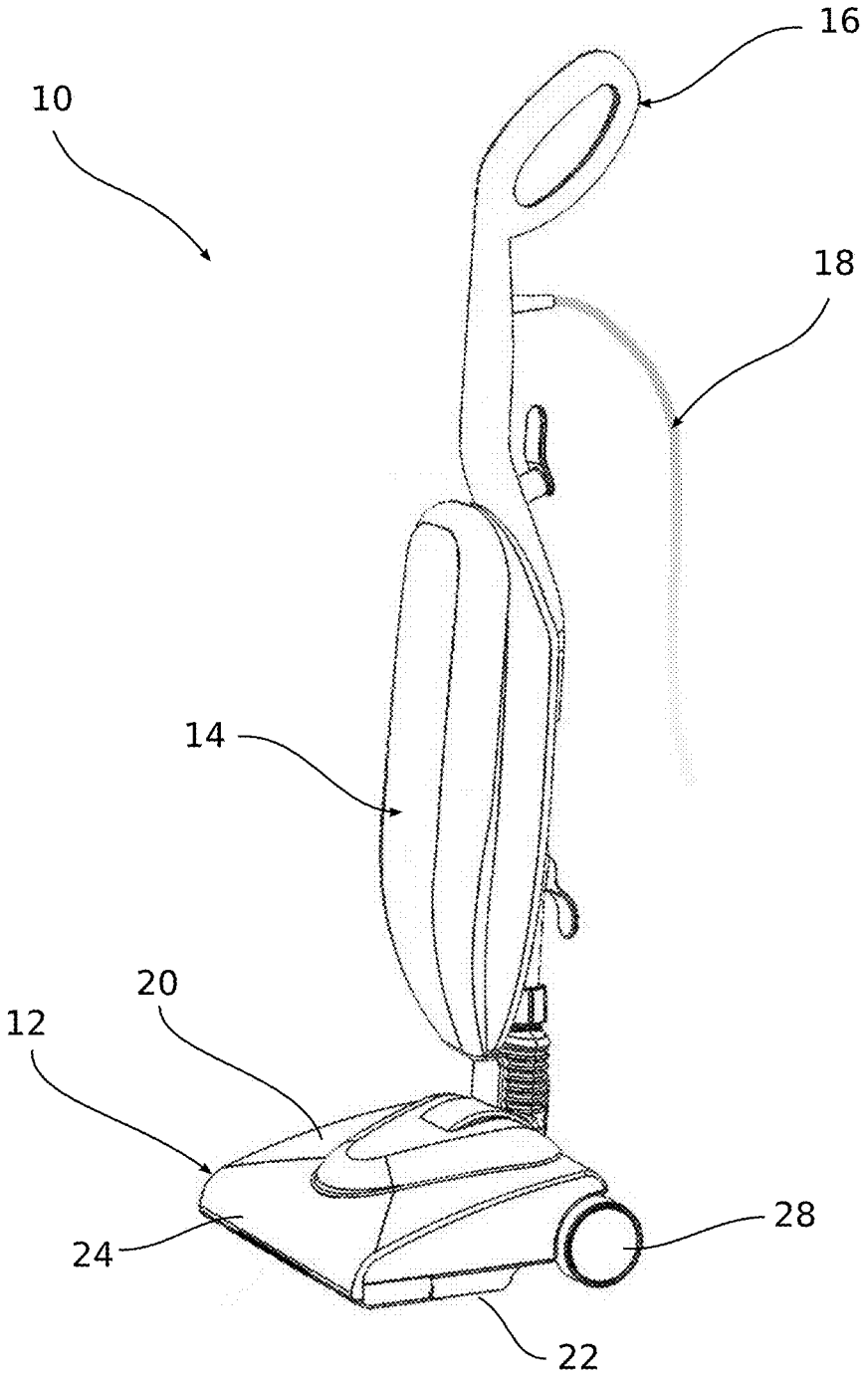
FIG. 1 is a perspective view of a vacuum cleaner in accordance with an exemplary embodiment.

As shown in FIG. 1, and according to various exemplary embodiments, an vacuum cleaner 10 includes a head or base 12, a housing 14 for receiving debris, for example a bag housing, a handle 16, and a cord 18 for connecting the vacuum cleaner 10 to a source of electrical power. The various components and interactions of the vacuum cleaner 10 would be understood by one of ordinary skill in the art.

The base 12 includes a top surface 20 and a lower surface 22. The top surface 20 includes a front portion 24, which may be curved as best shown in the exemplary embodiment of FIGS. 1-4. A set of front wheels 26 and a set of rear wheels 28 are connected to the base 12. The front and rear wheels 26, 28 facilitate pushing and pulling the vacuum cleaner 10 during operation. In an exemplary embodiment the front wheels 26 have an increased width and the rear wheels 28 have an increased diameter, respective to each other, to help reduce friction and allow the vacuum cleaner 10 to be used with a variety of carpet types.

A cover plate 30 and a brush roll 32 are connected to the lower surface 22 of the base 12. In an exemplary embodiment, the cover plate 30 secures the brush roll 32 to the base 12. The cover plate 30 has a plurality of fastener openings 34 to receive fasteners connecting the cover plate 30 to the base 12. The front wheels 26 can be connected to the cover plate 30 or directly to the base 12. In an exemplary, the cover plate 30 includes bearing housings 36 for receiving the front wheels 26. The cover plate 30 also includes an opening 38 for receiving the brush roll 32. The brush roll 32 is a rotating cylinder having a helical bristle 40 extending from the cylinder. Different types of brush rolls 32 or other carpet agitators may be used in place of, or in corporation with the cover plate 30.

Figure 5:
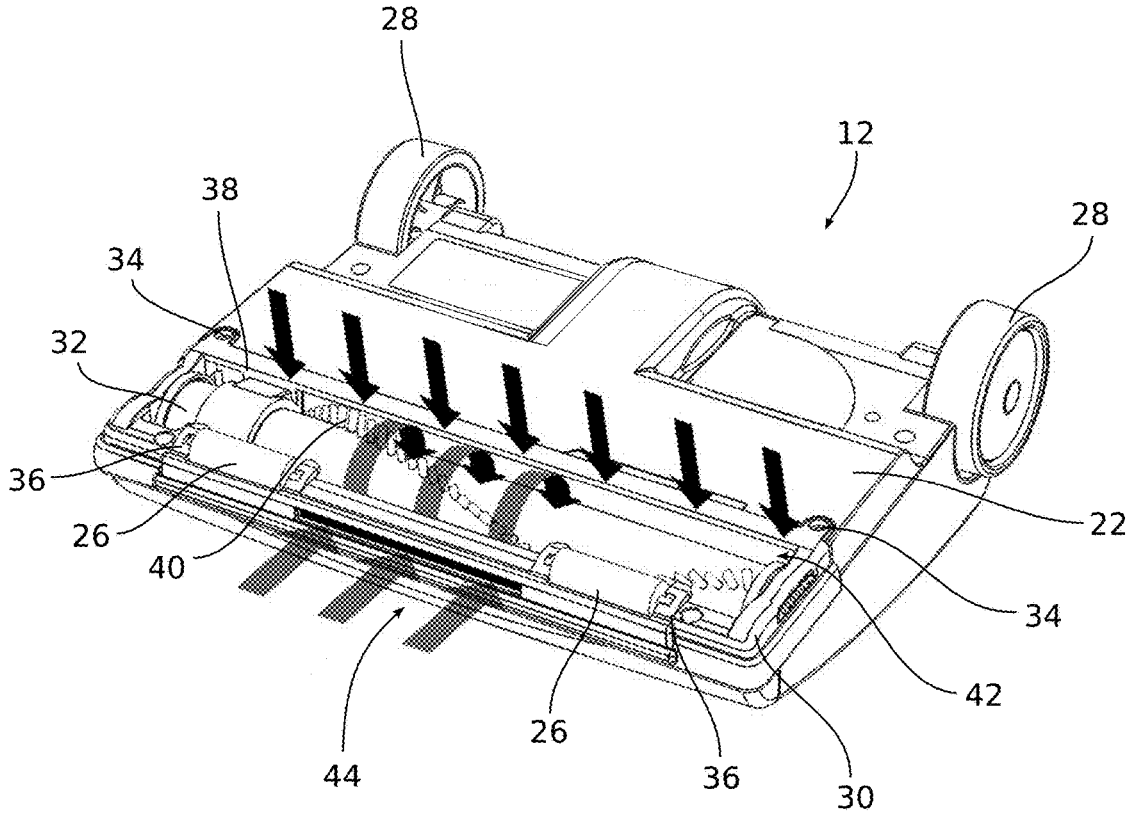
FIG. 5 is an lower perspective view of the base of the vacuum cleaner of FIG. 1.

As best shown in FIG. 5, the opening 38 in the cover plate 30 acts as a first inlet or suction inlet 42. Depending on the cover plate 30, the base 12, and the intended use of the vacuum cleaner 10, more air flow inlets may also be provided, including various apertures or slots.

Figure 7:
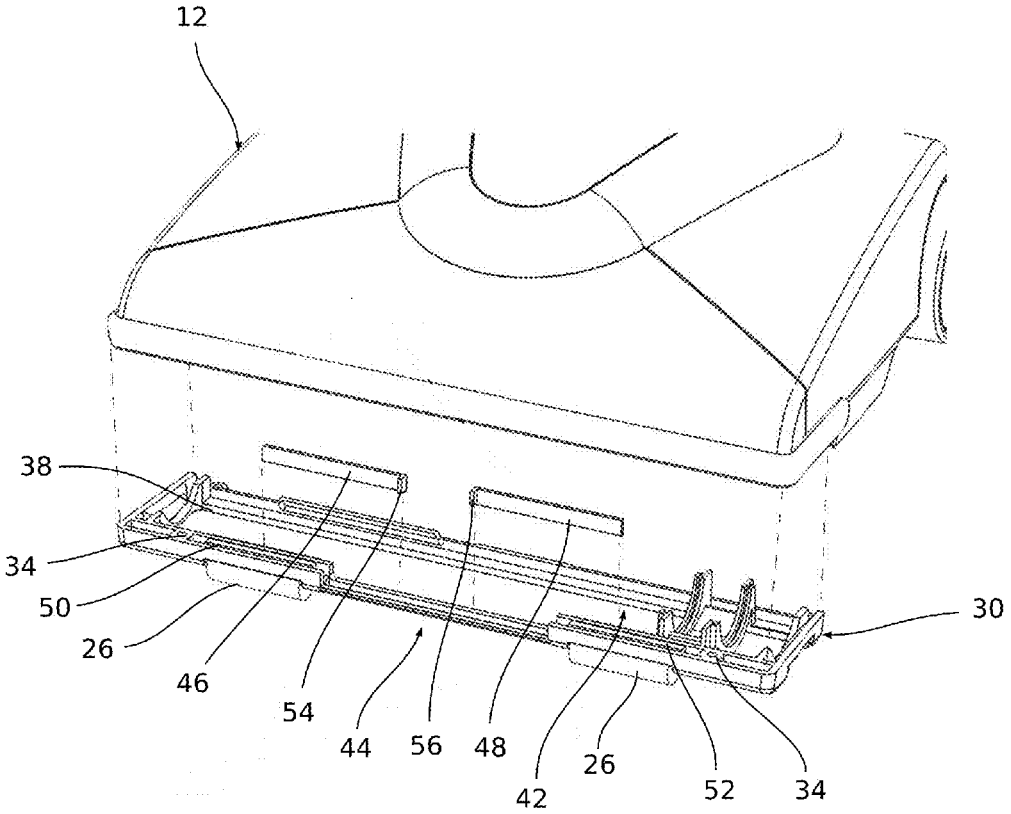
FIG. 7 is an exploded assembly view of the base of the vacuum cleaner of FIG. 1.

As best shown in the exemplary embodiment in FIGS. 2-5 and 7, the vacuum 10 includes a second inlet or vent 44, for example an adjustable vent 44. The vent 44 acts as a second air inlet. The vent 44 is positioned in the base 12, for example in the top surface 20 or lower surface 22. As best shown in FIGS. 5 and 7 of the exemplary embodiment, the vent 44 is incorporated with the cover plate 30. The vent 44 includes at least one moveable door, for example a first moveable door 46 and a second moveable door 48. The cover plate 30 includes at least one slot, for example a first slot 50 and a second slot 52, for slidably receiving the moveable doors 46, 48. In other exemplary embodiments, the doors 46, 48 may be pivoted or rotated with respect to the base 12 from a closed position to an open position. The doors 46, 48 can include a tab 54, 56 extending outwardly from the door 46, 48 away from the vacuum cleaner 10. The tabs 54, 56 allow a user to easily grasp and adjust the doors 46, 48, and can also act as a stop preventing the doors 46, 48 from sliding too far into the slots 50, 52 depending on the length of the slots 50, 52.

Figure 2:
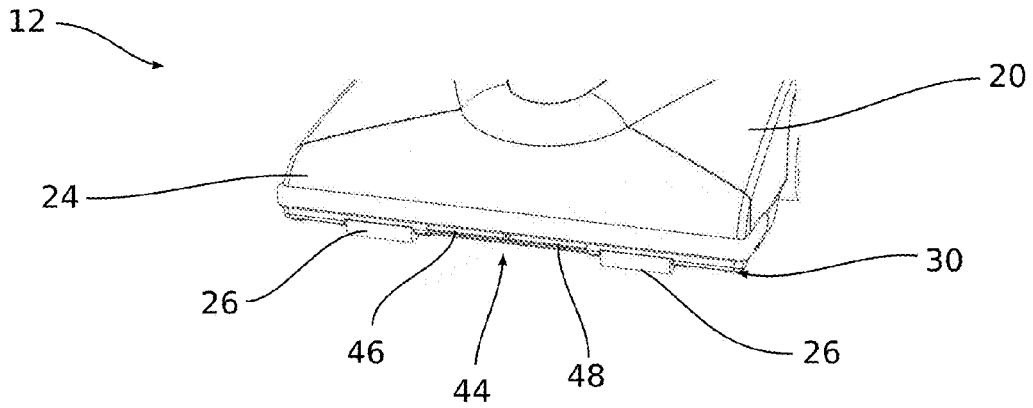
FIG. 2 is a perspective view of a base of the vacuum cleaner of FIG. 1 with a vent cover in a closed position.
Figure 3:
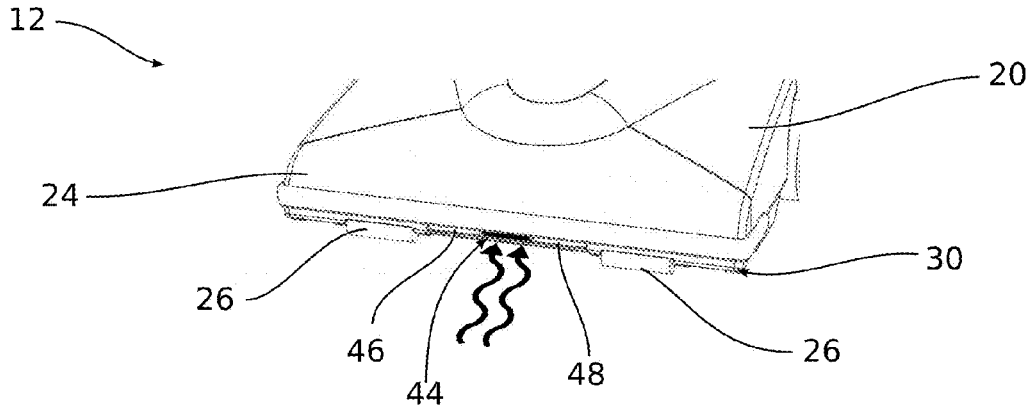
FIG. 3 is a perspective view of the base of the vacuum cleaner of FIG. 1 with the vent cover in a partially opened position.
Figure 4:
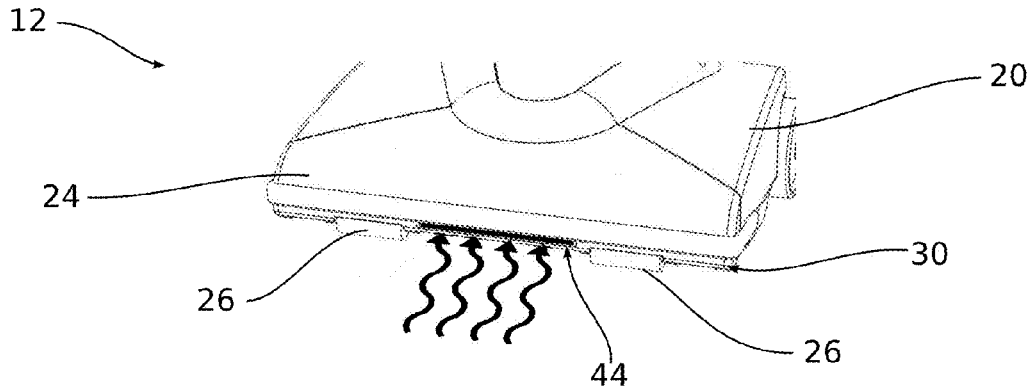
FIG. 4 is a perspective view of the base of the vacuum cleaner of FIG. 1 with the vent cover in a fully opened position.

As best shown in FIGS. 2-4, the vent 44 is variably adjustable by a user to different positions to increase the amount of airflow through the vent 44. The first and second doors 46, 48 are movable between a closed position shown in FIG. 2, a fully opened position shown in FIG. 4, an intermediate position shown in FIG. 3, and various other positions therebetween. In an exemplary embodiment, the doors 46, 48 are moveable between a first position that allows air to flow through the vent 44 and a second position that prevents at least a portion air from flowing through the vent 44. The second position, therefore, need not fully close the vent 44. The tabs 54, 56 facilitate moving the doors 46, 48 between desired positions.

Adjusting the amount of airflow through the vent 44, and therefore the vacuum 10 enables a person to adjust the suction of the vacuum cleaner 10. Softer carpets have an increased surface area of the fibers, which increases the drag across a surface with a vacuum cleaner. Additionally, the increased surface area increases the difficulty of pulling air through the carpet, which slows down or stops the mechanical beaters, such as a brush roll, of the vacuum cleaner. Soft yarn strands also lack the stiffness of traditional carpets, such that vacuum cleaners tend to sink in the soft carpets. The soft yarn strands tend to form a more complete seal around the vacuum cleaner base, thereby increasing suction at the point of contact with the soft carpet surface. The more the vacuum cleaner 10 base 12 sinks into the soft carpet, the greater the suction and the difficulty of operating the vacuum cleaner 10. Being able to adjust the airflow through the vent 44 allows a user to compensate for the issues raised with softer carpets, while also allowing a user to adjust the airflow for various different types of carpets.

For example, for stiffer carpet, the first and second doors 46, 48 can be set in a fully closed position, as shown in FIG. 2, such that no air flow is generated through the vent 44. The entire air flow passes through the suction inlet 42 in the lower surface 22 of the base 12. For softer carpet, the first and second doors 46, 48 can be moved to a fully opened position, as shown in FIGS. 4 and 5. Airflow is generated through the vent 44, thereby relieving suction through the suction inlet 42. By relieving the suction through the suction inlet 42, slowing down or stopping the brush roll 32 is relieved or eliminated. The additional air path through the vent 44 prevents the soft carpet strands from forming a complete seal with the suction inlet 42 that can stop operation of the vacuum cleaner 10. By drawing air in through both the suction inlet 42 and the vent 44, the vacuum cleaner 10 continuously operates when cleaning soft carpets. The vent 44 is preferably disposed above the free ends of the carpet strands of the carpet being cleaned, such that the carpet strands do not interfere with the airflow through the vent 44.

Figure 6:
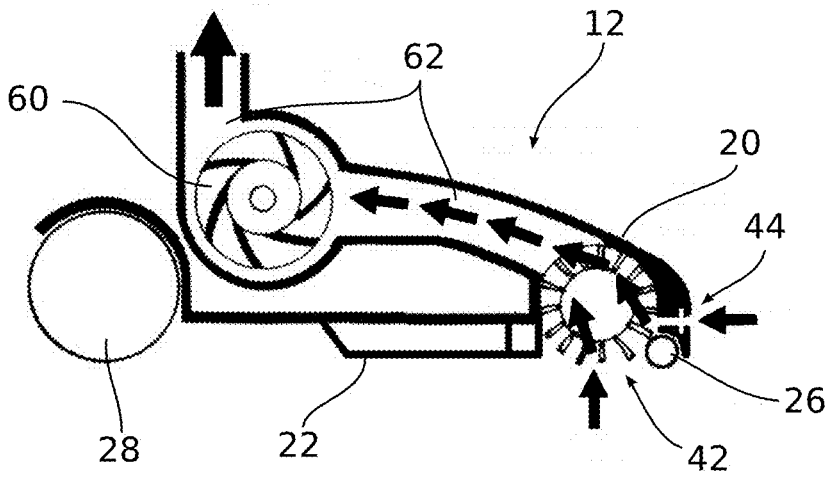
FIG. 6 is a side elevational view in cross section of the base of the vacuum cleaner illustrating the suction inlet, vent, and motor.

As best shown in FIGS. 5 and 6, and according to an exemplary embodiment, the vent 44 directs airflow to the base 12, for example a bottom region of the base 12 proximate the brush roll 32, for example in front of the brush roll 32 and the suction inlet 42. The vent 44 is positioned to receive air from in front of the of the base 12, for example approximately orthogonal to the longitudinal axis of the brush roll 32 or approximately orthogonal to the airflow of the suction inlet 42 or substantially orthogonal to a mean vector of the airflow through the suction inlet 42. Depending on the cover plate 30 and the brush roll 32, the flow of air through the vent 44 may oblique to the airflow through the suction inlet 42. In alternative embodiments, the vent 44 can be positioned to provide airflow at other locations of the base 12 or the suction path 58. The vent 44 is positioned in the base as close to the surface to be cleaned as possible. This allows for less venting, achieving sufficient suction to perform a cleaning operation on a carpet while still permitting mobility in softer carpets. For example, the vent 44 is positioned in the base 12, adjacent the lower surface 22, or positioned in the cover plate 30 positioned below the lower surface 22. In an exemplary embodiment the vent is positioned approximately within five inches of a surface to be cleaned. In another exemplary embodiment, the vent is positioned approximately within one inch of a surface to be cleaned.

A suction motor 60 is disposed in the base 12 of the vacuum cleaner 10, as shown in FIG. 6. Alternatively, the suction motor 60 can be disposed elsewhere, for example in the body of the vacuum cleaner 10 or in any other suitable location. The suction motor 60 generates a suction force, as shown in FIG. 6, at the suction inlet 42 and the vent 44, in the base 12, and through a suction path 62. The motor 60 also drives the brush roll 32. Alternatively, a separate motor 60 can be used to drive the brush roll 32.

When powered during operation of the vacuum cleaner 10, air is drawn into the suction path 62 through the suction inlet 42 in the lower surface 22 of the base 12. The suction path 62 continues to the filter bag (not shown) to collect dirt and debris. The filter bag can be disposed in the bag housing.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A vacuum cleaner comprising:

a housing;

a suction path in fluid communication with the housing;

a motor for creating flow through the suction path;

a base having a first inlet in fluid communication with the suction path, a second inlet adjustable between a first position allowing fluid to flow through the second inlet and a second position preventing at least a portion of fluid from flowing through the second inlet; and a surface agitator movably disposed in the base;

the second inlet being disposed below an uppermost part of the surface agitator.

2. The vacuum cleaner of claim 1, wherein the second inlet includes a door moveable between the first position and the second position.

3. The vacuum cleaner of claim 1, wherein the second inlet is approximately orthogonal to the first inlet.

4. The vacuum cleaner of claim 1, wherein the base includes a top surface, a lower surface, and a front portion and the second inlet is positioned proximate a surface to be cleaned with respect to the front portion.

5. The vacuum cleaner of claim 1, wherein the surface agitator includes a brush roll and the second inlet is positioned in front of the brush roll in a lengthwise direction of the base.

6. A vacuum cleaner comprising:

a housing;

a suction path in fluid communication with the housing;

a motor for creating flow through the suction path;

a base having a top surface, a lower surface, and a suction inlet in fluid communication with the suction path;

a surface agitator movably disposed in the base; and a cover plate connected to the lower surface having a vent opening, the vent opening being disposed below an uppermost part of the surface agitator.

7. The vacuum cleaner of claim 6, further comprising a door moveable between a first position preventing air from flowing through the vent opening and a second position allowing air to flow through the vent opening.

8. The vacuum cleaner of claim 7, wherein the door includes a tab.

9. The vacuum cleaner of claim 6, wherein the vent opening includes a moveable first door and a moveable second door.

10. The vacuum cleaner of claim 9, wherein the first and second doors are slidable relative to one another.

11. The vacuum cleaner of claim 6, wherein a first set of wheels rotatably connected to the base having a first length and a first diameter and a second set of wheels are rotatably connected to the base having a second length and a second diameter, the first length is greater than the second length, and the second diameter is greater than the first diameter.

12. The vacuum cleaner of claim 6, wherein the surface agitator is positioned in the suction inlet.

13. The vacuum cleaner of claim 12, wherein the vent opening is positioned in front of the surface agitator.

14. The vacuum cleaner of claim 6, wherein the surface agitator includes a brush roll, the cover plate a receiving the brush roll and a first set of wheels.

15. The vacuum cleaner of claim 6, wherein the cover plate includes a slot and a door slidably positioned in the slot.

16. The vacuum cleaner of claim 15, wherein the door includes a tab extending away from the base.

17. The vacuum cleaner of claim 16, wherein the base includes a front portion and the vent opening is positioned proximate to a surface to be cleaned with respect to the front portion.

18. The vacuum cleaner of claim 6, wherein the vent opening is substantially orthogonal to the suction inlet.

19. The vacuum cleaner of claim 6, wherein the vent opening is within approximately 5 inches of a surface to be cleaned.

20. A method of adjusting the airflow in a surface cleaner comprising:

positioning a surface cleaner adjacent to a surface, the surface cleaner having a base including a top surface, a lower surface, and a suction path, a motor for creating flow through the suction path, a suction inlet positioned in the base, a surface agitator movably disposed in the base, and an adjustable vent positioned in the base and in fluid communication with the suction path, the vent being disposed below an uppermost part of the surface agitator;

adjusting the vent selectively between a closed position and an open position to vary the amount of airflow through the suction path.

* * * * *